US005905925A

United States Patent [19]

Kawabata et al.

[11] Patent Number: 5,905,925

[45] Date of Patent: May 18, 1999

[54] IMAGE FORMATION APPARATUS FOR CHANGING OPERATION CONDITIONS BASED ON CHARACTERISTICS OF THE TRANSFER MATERIAL

[75] Inventors: Takashi Kawabata; Yukihiro Enomoto; Yukio Hayashi; Nobuo Hyakutake, all of Ebina, Japan

[73] Assignee: Fuji Xerox Co., Ltd., Tokyo, Japan

[21] Appl. No.: 08/982,640

[22] Filed: Dec. 2, 1997

[30] Foreign Application Priority Data

Dec. 4, 1996 [JP] Japan ..... 8-324042

[51] Int. Cl.[6] ..... G03G 15/16; G03G 15/00

[52] U.S. Cl. ..... 399/45; 399/66; 399/67; 399/81

[58] Field of Search ..... 399/45, 66, 67, 399/81, 46

[56] References Cited

U.S. PATENT DOCUMENTS

| | | | |
|---|---|---|---|
| 5,185,633 | 2/1993 | Kawai et al. | 399/45 |
| 5,424,821 | 6/1995 | Sampath | 399/45 |
| 5,655,176 | 8/1997 | Inoue et al. | 399/45 |
| 5,717,977 | 2/1998 | Suzuki et al. | 399/45 |
| 5,765,093 | 6/1998 | Funato | 399/406 |

FOREIGN PATENT DOCUMENTS

| | | |
|---|---|---|
| 54-91335 | 7/1979 | Japan . |
| 4-16889 | 1/1992 | Japan . |

*Primary Examiner*—Joan Pendegrass
*Attorney, Agent, or Firm*—Oliff & Berridge, PLC

[57] ABSTRACT

An image formation apparatus for transporting a transfer material P and forming an image on the transfer material P is provided with an operation mode dedicated to transfer materials of a multilayer structure In the operation mode, setting of at least one operation condition of an attraction condition of the transfer material P on a transfer material support 8, a transfer condition of a toner image to the transfer material P, a peeling condition of the transfer material P from the transfer material support 8, a fixing condition of a toner image onto the transfer material P, and a static electricity elimination condition of an image support 1 or the transfer material support 8 is changed in response to the characteristics of a resistance value, etc., of the transfer material P.

14 Claims, 7 Drawing Sheets

FIG.4

| TO BE CONTROLLED | | TACK FILM | CLOTH PAPER | CLOTH TRANSFER PAPER | PLAIN PAPER |
|---|---|---|---|---|---|
| ATTRACTION COROTRON | OUTPUT CURRENT DC COMPONENT μA | +50~80 | +120~180 | +120~180 | +100~150 |
| BEFORE-TRANSFER COROTRON | OUTPUT CURRENT DC COMPONENT μA | -600 | -500 | -500 | -400 |
| TRANSFER COROTRON | OUTPUT CURRENT μA | 10~15 | 15~20 | 15~20 | 20~25 |
| | ON TIMING FROM PAPER LEADING EDGE | 5 mm INSIDE | 5 mm INSIDE | ± 0mm | ± 0mm |
| | OFF TIMING FROM PAPER TRAILING EDGE | 10 mm INSIDE | 5 mm INSIDE | 5 mm INSIDE | ± 0mm |
| PEELING COROTRON | OUTPUT VOLTAGE AC COMPONENT (kV) | 4.0 | 3.8 | 4.0 | 3.5 |
| HEATING ROLL | HEATING TEMPERATURE (℃) | 140 | 170 | 130 | 150 |
| FIXING MOTOR | PAPER FEED RATE (mm/s) | 100 | 60 | 180 | 160 |
| START WHEEL | OPERATION/ STOP | STOP | OPER-ATION | STOP | STOP |
| CURL CONTROL | OPERATION/ STOP | STOP | STOP | STOP | STOP |
| PHOTO-SENSITIVE BODY STATIC ELECTRICITY ELIMINATION COROTRON | OUTPUT VOLTAGE AC COMPONENT (kV) | 4.0 | 3.8 | 4.0 | 2.7 |
| TRANSFER BODY STATIC ELECTRICITY ELIMINATION COROTRON | OUTPUT CURRENT AC COMPONENT μA | 800 | 700 | 700 | 600 |
| | DC COMPONENT μA | +400 | +300 | +300 | +200 |

IMAGE FORMATION APPARATUS FOR CHANGING OPERATION CONDITIONS BASED ON CHARACTERISTICS OF THE TRANSFER MATERIAL

BACKGROUND OF THE INVENTION

This invention relates to an image formation apparatus such as a copier or a printer and more particularly to an improvement to enable an image to be formed appropriately on not only a transfer material of a single composition such as paper or an OHP sheet, but also a transfer material of a multilayer structure such as a tack film, cloth paper, or a transfer material formed with a bonding layer.

For example, available as a conventional image formation apparatus for forming an image on a transfer material is an electrophotographic color image formation apparatus having an image support on which toner images of primary colors are formed in sequence in response to image information, transfer charge means being placed facing the image support, to which a predetermined transfer voltage is applied, a transfer material support being disposed rotatably so as to pass through a transfer position between the transfer charge means and the image support, a transfer tray for storing transfer materials, attraction charge means for electrostatically attracting a transfer material discharged from the transfer tray on the transfer material support, static elimination charge means for weakening the attraction force between the transfer support and the transfer material by static elimination, a peeling claw for peeling the transfer material subjected to the static elimination from the transfer material support, and a heating roll and a pressurization roll for heating and pressurizing the peeled transfer material.

The image formation apparatus thus configured charges the transfer material support and the transfer material by the attraction charge means, thereby attracting the transfer material on the transfer material support, then forms toner images of different colors on the image support in sequence and transfers the toner images to the transfer material by a transfer electric field in sequence for forming a multicolor toner image, then peels off the transfer material from the transfer material support by the static elimination charge means and the peeling claw and heats and pressurizes the peeled transfer material by fixing means for fixing the image on the transfer material, thereby forming the image on the transfer material.

By the way, the image formation apparatus for forming an image on a transfer material in such a manner, as seen from the fact that it is recognized as an office automation machine, has been developed as an apparatus for preparing general documents in offices. That is, such an image formation apparatus generally forms images on plain paper and OHP sheets; even a high-performance model brought to the commercial stage in recent years is only improved so that it can form an image at most on a standardized card such as a postcard.

Then, in response to an improvement in the image quality of image formation apparatuses or passable accomplishment of color image formation apparatuses in recent years, the inventors et al. tried forming an image on various transfer materials not intended formerly as transfer materials by image formation apparatuses, for example, transfer materials of a multilayer structure, such as tack films, cloth paper, and transfer materials formed with a thermally melted bonding layer. However, the result was poor; an image of proper quality can be formed on the transfer materials or the transfer materials cannot be transported from a paper tray to a discharge tray. The following problems are problems not arising when images are formed on plain paper, etc.,:

As a first general problem, in some cases, a transfer electric field produced at a transfer position or a transfer current flowing at a transfer position changes with transfer materials of a multilayer structure and toner on an image support cannot be appropriately transferred to the transfer material. Particularly, in the second or later transfer, no toner is transferred in some cases; an image degradation problem in color images is marked.

As a general problem at a fixing position, a transfer material of a multilayer structure and whole toner cannot be sufficiently heated because of the thickness of the transfer material of a multilayer structure and the color development property worsens in color images, etc.,; in an extreme case, only toner on the surface of multicolor toner image is melted and no image is fixed. Particularly, when only toner on the surface of multicolor toner image is melted on a highly insulated transfer material such as a tack film, the melted toner is deposited electrostatically on the surface of a heating roll and an image can be made dirty to such a degree that it cannot be distinguished with eyes at the next fixing time (this problem will be hereinafter referred to as "non-visual offset").

As a general problem related to transport of transfer materials, in some cases, the attraction position of a transfer material on a transfer material support shifts, a transfer material cannot appropriately be attracted on a transfer material support, or a transfer material cannot appropriately be peeled off from a transfer material support.

Although the following problems do not generally occur in transfer materials of a multilayer structure, as a hindrance to image formation, first if an image is formed on a lowly insulated transfer material of a multilayer structure, the transfer material is attracted on an image support, etc., at a transfer position or an attraction position at a considerable probability and further if a transfer material is luckily peeled off from an image support at a transfer position, the image support is charged up by peel discharge associated with the peeling and a toner band is formed on the next image.

If an image is formed on a transfer material formed on a surface with a coating under a damp condition, toner or moisture absorbed on the transfer material at a fixing position becomes water vapor at the fixing time and cannot escape, thus a missing image occurs as the water vapor is broken, which will be hereinafter referred to as toner blister, or a part of the coating is peeled off from the base material of the transfer material, which will be hereinafter referred to as paper blister.

When the electrophotographic color image formation apparatus is used to form an image on a transfer material, if the transfer material to which a toner image has been transferred is made to take a round with the transfer material held on the transfer material support, which will be hereinafter referred to as dummy cycle, and meanwhile the transport speed of the transfer material is slowed down for improving the fixing property, a part of toner is retransferred from the transfer material to the image support during the dummy cycle and image quality defects such as tone change occur.

SUMMARY OF THE INVENTION

It is therefore an object of the invention to provide an image formation apparatus that can form an image appropriately on a transfer material of a multilayer structure.

According to the invention, there is provided an image formation apparatus for transporting a transfer material and forming an image on the transfer material, the image formation apparatus comprising changed operation condition determination means being responsive to characteristics of the transfer material for determining an operation condition with setup values of plain paper to be changed from among image formation operation conditions.

According to the invention, there is provided an image formation apparatus for transporting a transfer material and forming an image on the transfer material, the image formation apparatus comprising setup value change means being responsive to characteristics of transfer material of a multilayer structure for changing setup values of plain paper for at least one operation condition of an attraction condition of the transfer material on a transfer material support, a transfer condition of a toner image to the transfer material, a peeling condition of the transfer material from the transfer material support, a fixing condition of a toner image onto the transfer material, and a static electricity elimination condition of an image support or the transfer material support.

The image formation apparatus using the invention may be any apparatus that can transport a transfer material and form an image on the transfer material, such as a color image formation apparatus which attracts a transfer material on a transfer material support and superimposes color toner images formed in sequence on an image support on each other on the transfer material for transfer (see FIG. 7A), a color image formation apparatus which attracts a transfer material on a transfer material support and transfers a toner image of a first color from an image supports then superimposes toner images of second and later colors formed on the image support on each other for transfer (see FIG. 7B), a color image formation apparatus which superimposes color toner images from image supports provided in a one-to-one correspondence with colors on each other on a transfer material attracted on a transfer material support for transfer (see FIG. 7C), a color image formation apparatus which superimposes color toner images on each other on an image supports then transfers the resultant image to a transfer material (see FIG. 8A) or a color image formation apparatus which superimposes color toner images formed on an image support on each other on an intermediate transfer body and transfers the resultant multicolor toner image to a transfer material (see FIG. 8B).

The image support may be any image support at least on which toner images can be formed, such as a photosensitive drum or a photosensitive belt. The transfer material support may be any transfer material support that can electrostatically attract a transfer material, such as a transfer belt or a transfer drum.

In the invention, the term "transfer material of a multilayer structure" is used to mean a material having a lamination structure of at least two or more different compositions and being formed like a sheet as a whole, such as a tack film used for labels, stickers, etc., cloth paper used as a luncheon mat or a carpet, or a transfer material formed with a thermally melted bonding layer used to form a print pattern on a tee shirt, a sweat suit, etc. by thermal transfer with an iron, etc.

The term "characteristics of transfer material of multilayer structure" in the invention, which varies depending on the problem occurring on the transfer material, generally is used to mean the characteristics of the electric resistance values of the transfer material such as the area resistance value on the image formation face of the transfer material and the volume resistance value of the transfer material, the heat capacity of the transfer material, etc.

The term "attraction conditions of transfer material on transfer material support" in the invention is used to mean operation conditions when the transfer material is attracted on the transfer material support and specifically the applied voltage value, the output current value, or the voltage application timing to the attraction charge means used to attract the transfer material on the transfer material support, the move speed of the transfer material support when the transfer material is attracted, and the like.

The term "transfer conditions of toner images to transfer material" in the invention is used to mean operation conditions when toner images on a toner image support such as an intermediate transfer body or an image support are transferred onto the transfer material and specifically the applied voltage value, the output current value, or the voltage application timing to the transfer charge means used to transfer the toner images onto the transfer material, the applied voltage value to the before-transfer charge means for adjusting the toner image charge state just before the toner images are transferred onto the transfer material, or the output current value, the move speed of the transfer material support when the toner images are transferred onto the transfer material, and the like.

The term "peeling conditions of transfer material from transfer material support" in the invention is used to mean operation conditions when the transfer material is peeled off from the transfer material support and specifically the applied voltage value, the output current value, or the voltage application timing to the attraction charge means used to eliminate static electricity when the transfer material is peeled off from the transfer material support, the operation and stop timings of the peeling claw used to peel off the transfer material from the transfer material support, the move speed of the transfer material support while the peeling claw is operated, and the like.

The term "fixing conditions of toner image on transfer material" in the invention is used to mean operation conditions when toner image is fixed on the transfer material and specifically the heating temperature of the fixing means used to fix the toner image on the transfer material, the transfer material move speed at the fixing time, and the like.

The term "static electricity elimination conditions of image support" in the invention is used to mean operation conditions when static electricity of the image support is eliminated before formation of another toner image after one toner image is transferred and specifically the applied voltage value or the output current value to the static electricity elimination charge means used to eliminate static electricity of the photosensitive drum, the image support move speed at the static electricity elimination time, and the like.

The term "static electricity elimination conditions of transfer material support" in the invention is used to mean operation conditions when static electricity of the transfer material support is eliminated before attraction of another transfer material after one transfer material is peeled off and specifically the applied voltage value or the output current value to the static electricity elimination charge means used to eliminate static electricity of the transfer material support, the transfer material support move speed at the static electricity elimination time, and the like.

In the operation mode dedicated to transfer materials of a multilayer structure in the invention, setting of at least one operation condition of the attraction condition of the transfer material on the transfer material support, the transfer condition of toner image to the transfer material, the peeling condition of the transfer material from the transfer material support, the fixing condition of toner image onto the transfer material, and the static electricity elimination condition of the image support or the transfer material support may be changed in response to the characteristics of the transfer material. For example, setting of the operation conditions of various charge means, such as the before-transfer charge means, the transfer charge means, the attraction charge means, the peel charge means, and the static electricity elimination charge means, may be changed in response to the electric resistance value of the transfer material, setting of the operation conditions of the fixing means may be changed in response to the heat capacity of the transfer material, or setting of the operation conditions of the peeling claw and setting of the move speed of the transfer material support may be changed in response to the firmness of the transfer material. As general setting change, when an image is formed on a transfer material of a multilayer structure, setting may be changed so that output of the various charge means is raised as the insulation property of the transfer material is higher, that the peeling claw is operated fast as the transfer material is less firm, and that the fixing temperature is raised as the heat capacity of the transfer material is larger.

Therefore, the operation mode dedicated to transfer materials of a multilayer structure is provided in the image formation apparatus of the invention and in the operation mode, setting of at least one operation condition of the attraction condition of the transfer material on the transfer material support, the transfer condition of toner image to the transfer material, the peeling condition of the transfer material from the transfer material support, the fixing condition of toner image onto the transfer material, and the static electricity elimination condition of the image support or the transfer material support is changed in response to the characteristics of the transfer material, so that an image can be formed on the transfer material under appropriate operation conditions.

Particularly when an image is formed on a transfer material of a multilayer structure low in insulation property, setting of the transfer condition or the attraction condition may be changed so as to delay the application timing of a voltage to the transfer charge means or the attraction charge means as compared with the application timing for plain paper and accelerate the stop timing of the applied voltage to the transfer charge means or the attraction charge means as compared with the stop timing for plain paper, whereby the image support and the transfer material are prevented from being attracted or peel discharge does not occur at the transfer time or the attraction time and an accident such that a toner band caused by peel discharge at the fixing time is formed at the next image formation time is also prevented from occurring. In this case, preferably the operation conditions are changed by setting the insulation threshold value to about $10^5$ cm.

Particularly when an image is formed on a transfer material of a multilayer structure high in insulation property, setting of the fixing condition may be changed so as to accelerate the transfer material transport speed at the fixing time as compared with the transport speed of plain paper, whereby when only toner of a part of a multicolor toner image, etc., is melted, the melted toner becomes hard to be deposited on the fixing roll and nonvisual offset can be prevented.

Particularly when an image is formed on a transfer material of a multilayer structure formed on a surface with a coating, the transfer material transport speed at the fixing time may be slowed down as compared with the transport speed of plain paper and the fixing temperature may be raised as compared with the fixing temperature of plain paper, thereby preventing toner blister or paper blister from occurring.

Particularly when an image is formed on a transfer material of a multilayer structure formed with a bonding layer, the transfer material transport speed at the fixing time may be accelerated as compared with the transport speed of plain paper and the fixing temperature may be lowered as compared with the fixing temperature of plain paper, thereby preventing the bonding layer from being melted at the fixing time and being peeled off.

Particularly when a dummy cycle is executed in the image formation apparatus having a transfer material, the transfer charge means may be operated also in the cycle, thereby preventing toner from being retransferred from a transfer material to an image support or toner on the transfer material being from scattered.

By the way, in the image formation apparatus having the operation mode dedicated to transfer materials of a multilayer structure, to operate the operation mode, for example, the special paper button displayed on the user interface may be selected and the operation mode may be changed accordingly. The setup values responsive to the characteristics of transfer materials are prestored in the apparatus and the setup values of the apparatus operation conditions used in the operation mode dedicated to transfer materials of a multilayer structure may be determined based on the prestored setup values, may be determined by entering or selecting the characteristics of a transfer material and performing operations, etc., in response to the characteristic values, or may be determined by measuring the characteristics of a transfer material before image formation and using the measurement result.

To prestore the setup values responsive to the characteristics of transfer materials in the apparatus and set the apparatus operation conditions based on the prestored setup values, only one setup value corresponding to a sheet material may be stored and set; however, preferably the water content of a transfer material etc., is considered for determining a setup value, whereby a more appropriate setup value can be produced. To consider the water content for determining a setup value, a plurality of setup values responsive to the water contents of sheet materials may be stored in a look-up table or correction coefficients responsive to the water contents of sheet materials may be stored and the basic setup values may be corrected according to the correction coefficients whenever necessary.

To prestore the setup values responsive to the characteristics of transfer materials in the apparatus and change setting of the apparatus operation conditions based on the prestored setup values, the setup values of a plurality of transfer materials may be stored rather than only the setup value of a transfer material is stored. In this case, for example, the user may enter the type, trade name, or part number of transfer material through the user interface or may select the button corresponding to the type, trade name, or part number of transfer material displayed on the user interface.

As a method of prestoring the setup values responsive to the characteristics of transfer materials in the apparatus, for example, the setup values may be stored before shipment of the apparatus or the user may enter or change the setup values after shipment of the apparatus. The storage medium for prestoring the setup values responsive to the characteristics of transfer materials in the apparatus may be a memory built in the apparatus or a removable memory like an IC card.

Next, to enter or select the characteristics of a transfer material and change setting of the apparatus operation conditions based on the calculation values of the characteristics, the characteristic values such as the electric resistance value and the heat capacity of the transfer material may be directly entered or the thickness, basis weight, etc., of the transfer material may be entered. When the setup values are calculated or selected out of the table based on the characteristics, the water content of the transfer material may also be considered.

Last, to measure the characteristics of a transfer material before image formation and change setting of the apparatus operation conditions based on the measurement result, the electric resistance value and the heat capacity of the transfer material may be measured and the setup values may be calculated or selected out of the table based on the measurement result or the thickness and basis weight of the transfer material may be measured and converted into the electric resistance value and the heat capacity, then the setup values may be calculated or selected out of the table. In the latter case, when the setup values may be calculated or selected out of the table, the water content of the transfer material may also be considered.

As a method of measuring the characteristics of a transfer material, dedicated measurement means may be built in the apparatus; while the transfer material is transported before image formation, various charge means, etc., may be used to measure the characteristics of the transfer material. To measure the characteristics of the transfer material during the transport, the measurement operation may be executed in the normal image formation cycle or as a different cycle before image formation or an image formation cycle may be executed following the measurement. In the latter cases, the measurement operation and the image formation operation can be separated, thus the characteristics throughout the transfer material can be measured and average values can be set as measurement values; the setup values of the apparatus operation conditions can be made more appropriate. To continuously form images on a plurality of transfer materials, the characteristics of only the first one may be measured.

As a method of transporting a sheet and measuring the characteristics thereof during the transporting, for examples to measure the electrical characteristics of a transfer material, the attraction charge means is made up of a corotron disposed on the rear of the transfer material support and an opposed roll disposed on the surface of the transfer material support (the side on which the transfer material is attracted), then the current value flowing into the opposed roll may be measured or the current value flowing into the image support at the transfer time may be measured.

BRIEF DESCRIPTION OF THE DRAWINGS

In the accompanying drawings:

FIG. 3A shows a function selection screen, and FIG. 3B shows a transfer material selection screen;

FIG. 4 is a table of setting operation conditions on various transfer materials of a multilayer structure, stored in the image formation apparatus in FIG. 1;

DETAILED DESCRIPTION OF THE PREFERRED EMBODIMENTS

Referring now to the accompanying drawings, there are shown preferred embodiments of the invention.

First Embodiment

Figure 1:
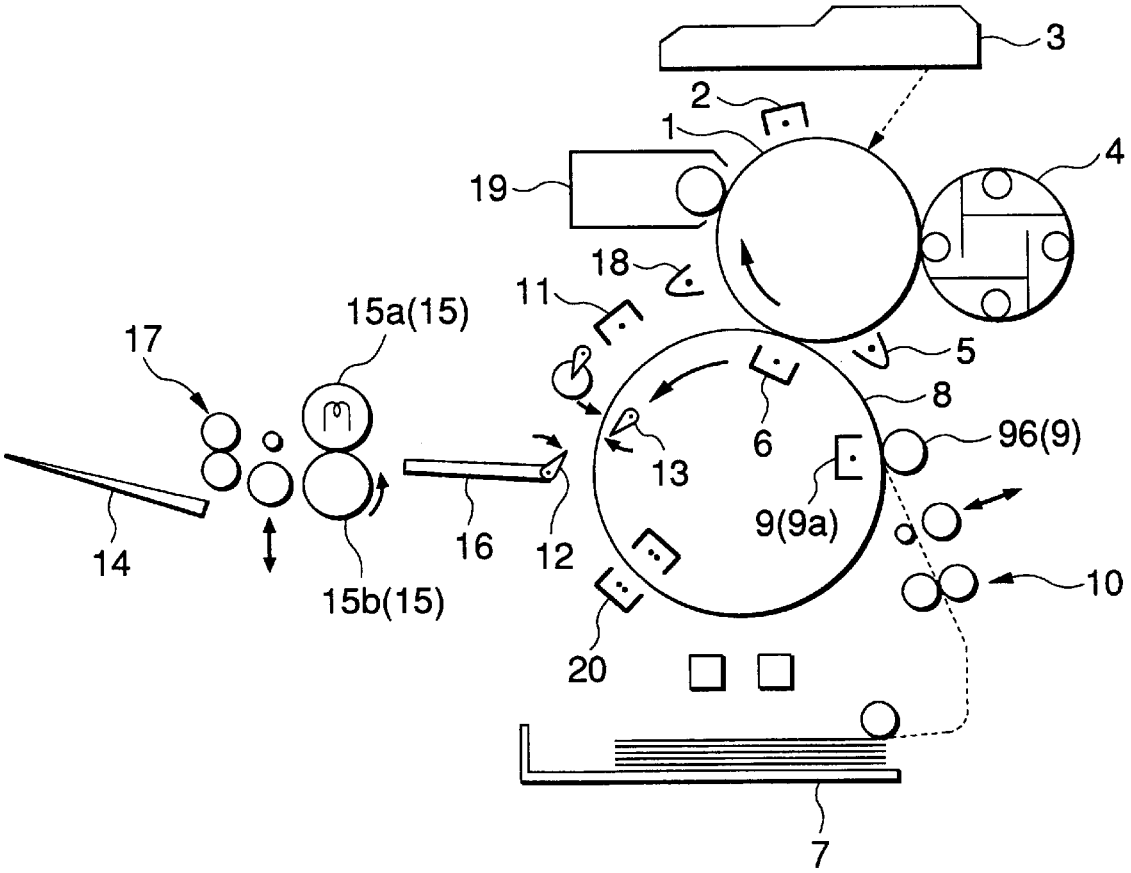
FIG. 1 is a schematic drawing of the configuration of an image formation apparatus in a first embodiment of the invention.

FIG. 1 shows a color image formation apparatus according to a first embodiment of the invention. This image formation apparatus can form single-color toner images of yellow, magenta, cyan, and black, superimpose the single-color toner images on each other on a transfer material P, and heat and pressurize the multicolor toner image formed on the transfer material P for melting and color development, thereby forming a full color image on the transfer material P.

In FIG. 1, numeral 1 is a photosensitive drum rotatably disposed, numeral 2 is a charge corotron for charging the photosensitive drum 1 at a uniform potential, numeral 3 is a laser exposure device for exposing the charged photosensitive drum 1 to light in response to image information of colors, numeral 4 is a developing device for depositing a predetermined color toner on the photosensitive drum 1 exposed to light, numeral 5 is a before-transfer corotron for adjusting the toner charge amount on the photosensitive drum 1, and numeral 6 is a transfer corotron for transferring the toner on the photosensitive drum 1 to a transfer material P supplied to a transfer position between the transfer corotron 6 and the photosensitive drum 1 by applying a transfer voltage therebetween. An electrostatic latent image is formed on the photosensitive drum 1 by the charge corotron 2 and the laser exposure device 3 and is developed by the developing device 4 to form a toner image, which then is transferred to the transfer material P by the transfer corotron 6 for forming each single-color toner image on the transfer material P.

In FIG. 1 numeral 7 is a transfer tray capable of storing a large number of transfer materials P, numeral 8 is a transfer drum rotatably disposed so as to allow the transfer material P to pass through the transfer position, numeral 9 is attraction means having an attraction corotron 9*a* and an opposed roll 9*b* placed so as to sandwich the transfer drum 8 therebetween for electrostatically attracting the transfer material P supplied to an attraction position between the attraction corotron 9*a* and the opposed roll 9*b* on the transfer drum 8, numeral 10 is a registration roll pair for supplying the transfer material P discharged from the transfer material tray 7 to the attraction position at a predetermined timing, numeral 11 is a peeling corotron for weakening the electrostatic attraction force between the transfer drum 8 and the transfer material P, numeral 12 is a peeling finger being disposed detachably on the outer peripheral surface of the transfer drum 8 for peeling off the transfer material P attracted on the transfer drum 8, numeral 13 is a push-up arm for pushing up the transfer material P from the inside of the transfer drum 8 during the operation of the peeling finger when the transfer paper P is peeled off, numeral 14 is a discharge tray for discharging the transfer material P on which an image has been formed, numeral 15 is fixing means being disposed between the transfer drum 8 and the discharge tray 14 for heating and pressurizing the transfer material P at a fixing position between a heating roll 15*a* and a pressurizing roll 15*b*, numeral 16 is a transfer material P guide for supplying the peeled-off transfer material P to the fixing position, and numeral 17 is a discharge roll pair for discharging the fixed transfer material P into the discharge tray 14. The transfer material P discharged from the transfer material tray 7 is discharged through the registration roll pair 10, is attracted on the transfer drum 8 by the attraction means 9, rotates together with the transfer drum 8, is peeled off from the transfer drum 8 by the peeling corotron 11, the push-up arm 13, and the peeling finger 12, and is heated and pressurized at the fixing position, then is discharged into the discharge tray 14.

The color image formation apparatus thus configured can form single-color toner images in sequence on the photosensitive drum 1 with the transfer material P attracted on the transfer drum 8 and can transfer the single-color toner images formed on the drum 1 onto the transfer material P in sequence, thereby forming a multicolor toner image comprising the single-color toner images superimposed on each other on the transfer material P. Further, the color image formation apparatus can heat and pressurize the transfer material P formed with the multicolor toner image at the fixing position, thereby forming a full color image on the transfer material P.

In FIG. 1, numeral 18 is a photosensitive body static electricity elimination corotron for eliminating static electricity of the photosensitive drum 1 after transfers numeral 19 is a photosensitive body cleaner for cleaning the surface of the photosensitive drum 1 after the static electricity elimination, and numeral 20 is a transfer body static electricity elimination corotron for eliminating static electricity of the transfer drum 8 after the transfer material is peeled off. The state of the photosensitive drum 1 and the transfer drum 8 can be maintained for continuous image formation by operating the members.

Figure 2:
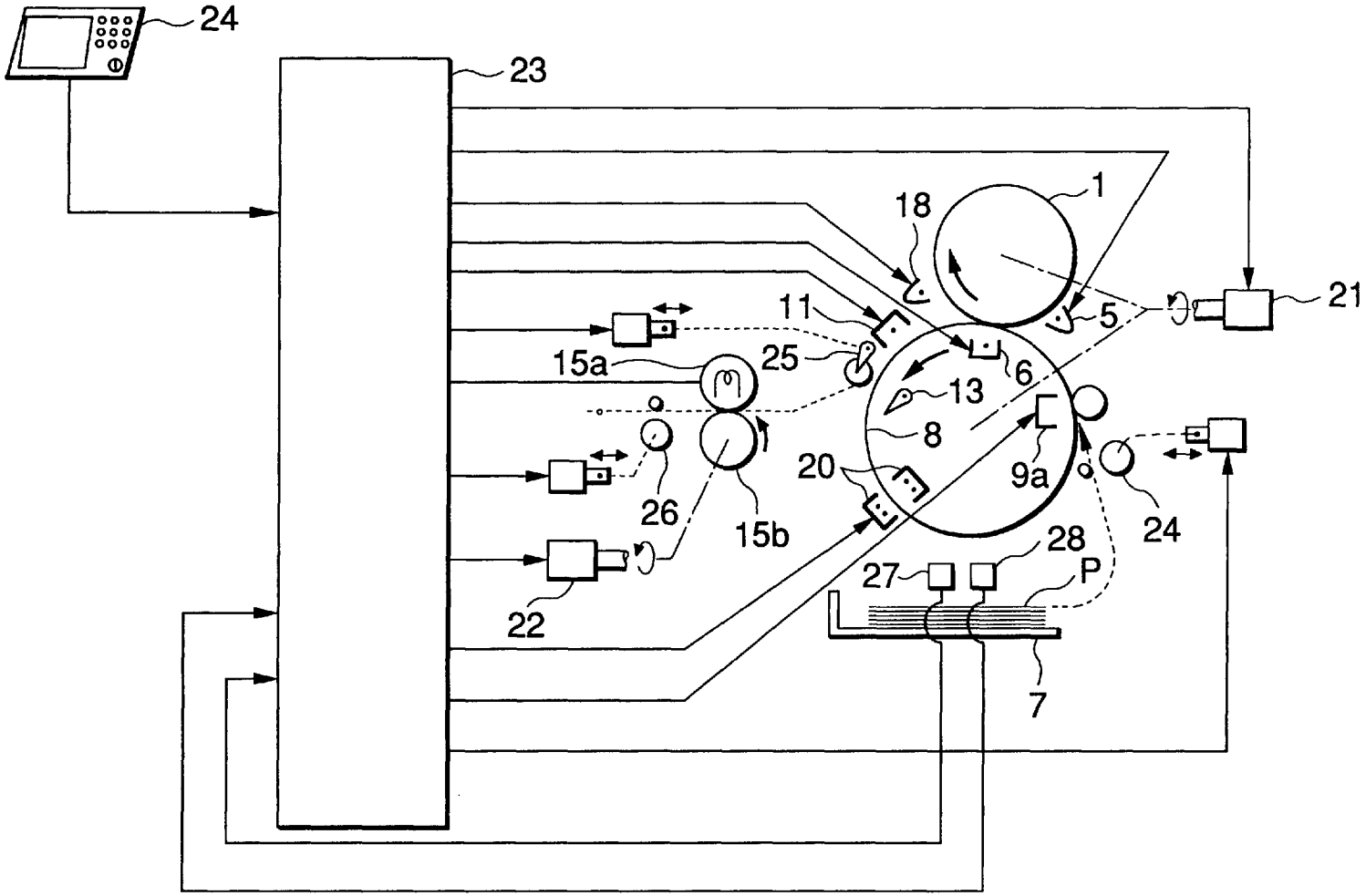
FIG. 2 is a conceptual drawing of an image condition control apparatus in the image formation apparatus in FIG. 1.

By the way, the image formation apparatus further includes control means 23 for supplying electric power to a process drive motor 21 for driving the photosensitive drum 1, etc., and a drive motor 22 of the pressurizing roll 15*b* whenever necessary. The members are operated in response to setting of the control means 23. Then, in the embodiment, the operation conditions of the members under the control means 23 can be changed through a user interface unit (described later), as shown in FIG. 2. The image formation apparatus of the embodiment is also provided with a curler 24 having a pair of rolls different in outer diameter for sandwiching transfer material P between the rolls and curling the transfer material P just before the transfer material P is attracted on the transfer drum 8, a star wheel 25 for pressing the transfer material P against the transfer drum 8 so as to prevent the transfer material P from floating from the transfer drum 8 when the transfer material P is peeled off, and a decurler 26 for decurling the curl produced on the transfer material P before it is discharged so that the image formation apparatus can form an image on even firm transfer material P appropriately. They can also be operated whenever necessary.

Changed operation condition determination means may be means for the user to enter a command directly on a display screen or means for determining transfer material characteristics based on the sense result.

Specific operation conditions changed in the embodiment are output voltages of the attraction corotron 9*a*, the before-transfer corotron 5, the transfer corotron 6, and the peeling corotron 18, the heating temperature of the heating roll 15*a*, output voltages of the photosensitive body static electricity elimination corotron 18 and the transfer body static electricity elimination corotron 20, the rotation speed of the process motor 21 for driving the photosensitive drum 1 and the transfer drum 8, the rotation speed of the pressurizing roll 15*b*, the start and stop timings of the transfer corotron 6, and operation or nonoperation of the curler 24, the star wheel 25, and the decurler 26. If a tack film, cloth paper, a transfer material formed with a thermally melted bonding layer, or the like is selected as transfer material P, the operation conditions are changed.

The tack film used in the embodiment is of a structure wherein an acrylic bonding layer and a polyethylene terephthalate (PET) surface image reception layer are laminated in order on a PET base layer; it is used for labels, stickers, etc. The cloth paper has a structure wherein an acrylic resin, etc., is laminated on a polyethylene (PE) base layer; it is used as a luncheon mat or a carpet. The transfer material formed with a thermally melted bonding layer has a structure wherein a thermally melted bonding layer is laminated on plain paper, etc.,; after an image is formed on the thermally melted bonding layer, the bonding layer and the image are thermally transferred to a tee shirt or a sweat suit for printing a print pattern.

Figure 3A:
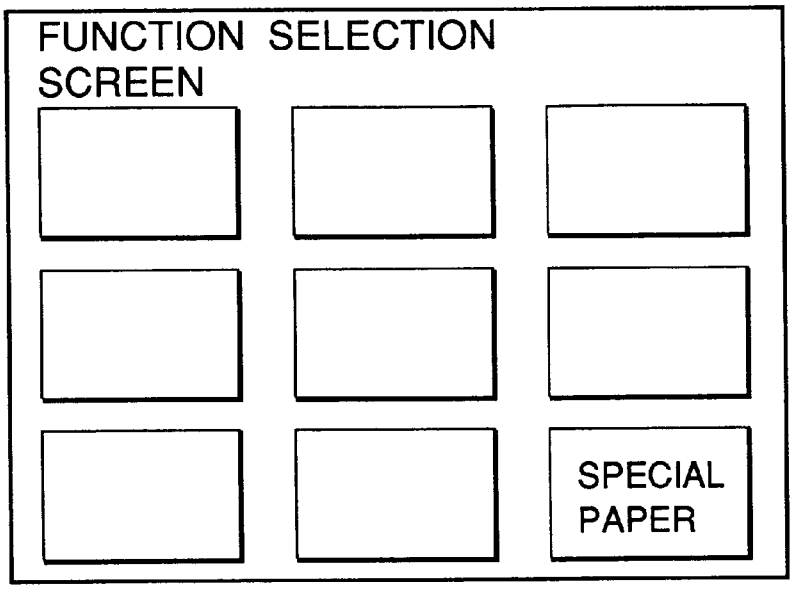
FIGS. 3A and 3B are illustration to show display screens of a user interface unit.
Figure 3B:
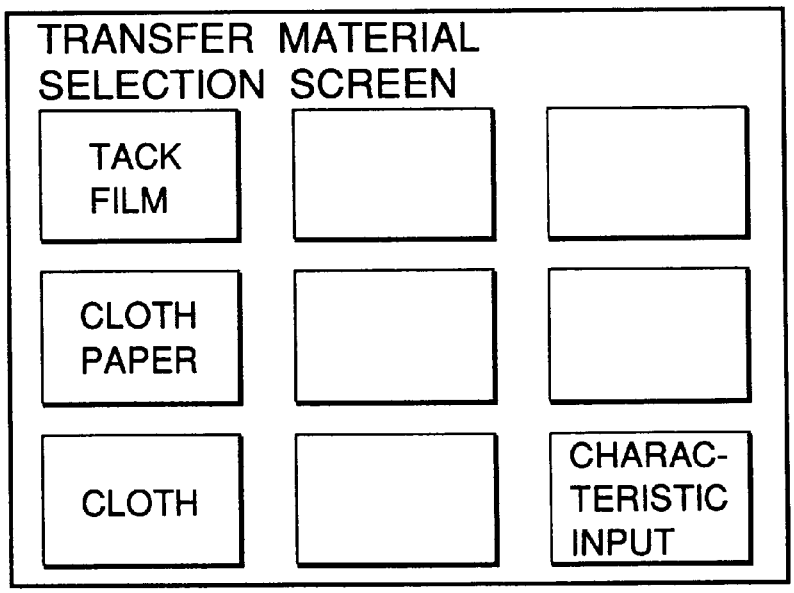

On the other hand, the user interface unit 24 adopts a touch panel as an input/output unit. In the embodiment, a special paper mode selection key is displayed on a function selection screen as shown in FIG. 3A (first display screen) and if the key is selected, further selection keys corresponding to a tack film, cloth paper, and the transfer material formed with a thermally melted bonding layer are displayed on a transfer material selection screen as shown in FIG. 3B (second display screen). A mode selection signal is output to the control means 23 in response to selection of one of the selection keys. When the user specifies a characteristic input key on the second display screen, a third display screen can also be displayed for the operator to set the operation.

The characteristic input key on the transfer material selection screen can be used for the user to enter the characteristic of a transfer material not displayed on the screen for forming an image on the transfer material. In this cases the control means 23 calculates and determines the operation conditions of the members based on the entered characteristic. That is, the user interface unit 24 has the display unit comprising the first display screen for selecting one from among a plurality of types of transfer materials containing transfer materials of a multilayer structure, the first key for selecting transfer materials of a multilayer structure out of the first display screen, and the second display screen displayed in exchange for a part or all of the first display screen when the first key is pressed, the second display screen having one or more second keys to enable the user to select one from among transfer materials of a multilayer structure. To use a transfer material of a multilayer structure other than the transfer materials of a multilayer structure, the characteristic values of the transfer material of a multilayer structure can also be entered on the second display screen, whereby the image formation apparatus can cover all transfer materials of different characteristics.

Figure 5:
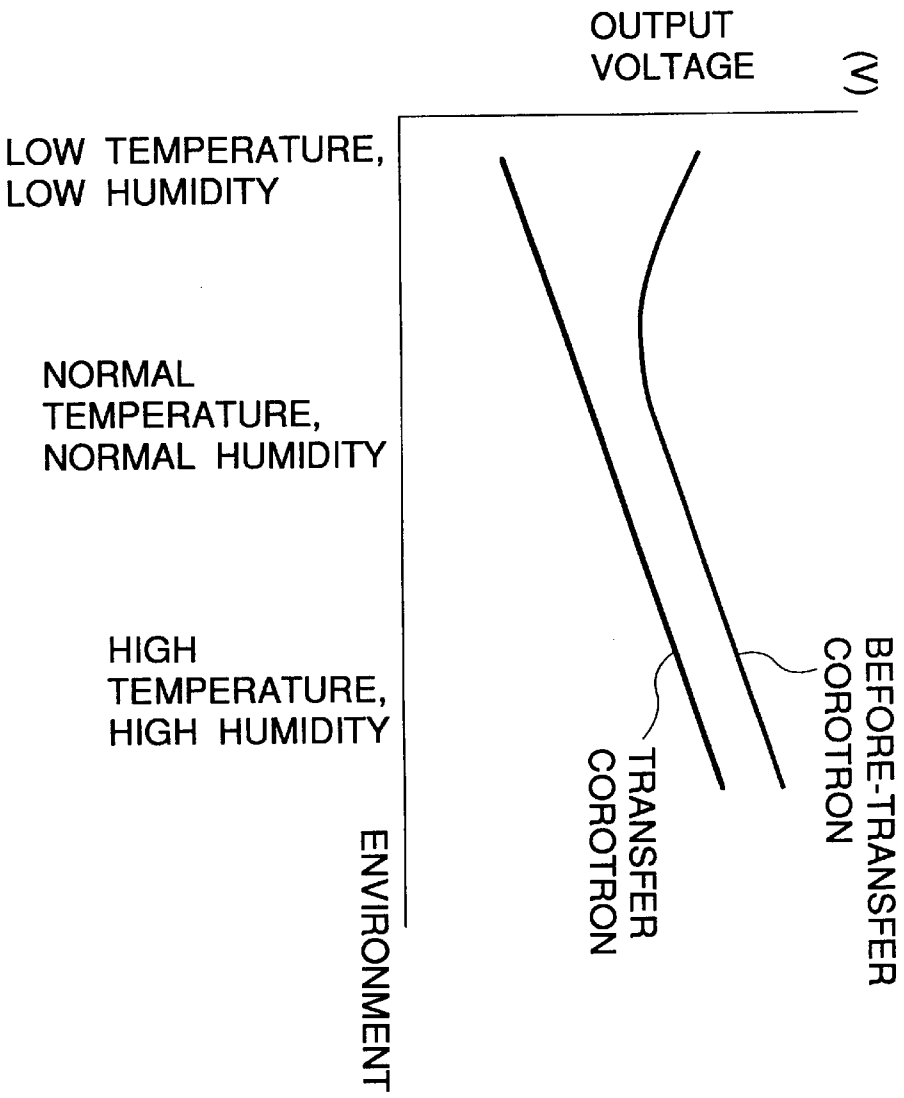
FIG. 5 is a temperature characteristic graph of output voltages of a before-transfer corotron and a transfer corotron.
Figure 6:
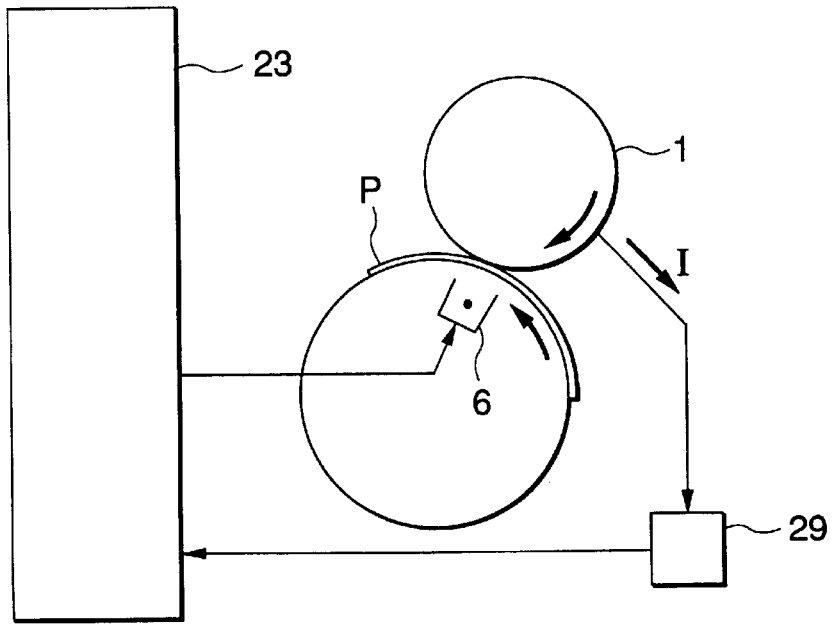
FIG. 6 is a schematic drawing of the configuration of a characteristic measurement apparatus of transfer material in a second embodiment of the invention.
Figure 7A:
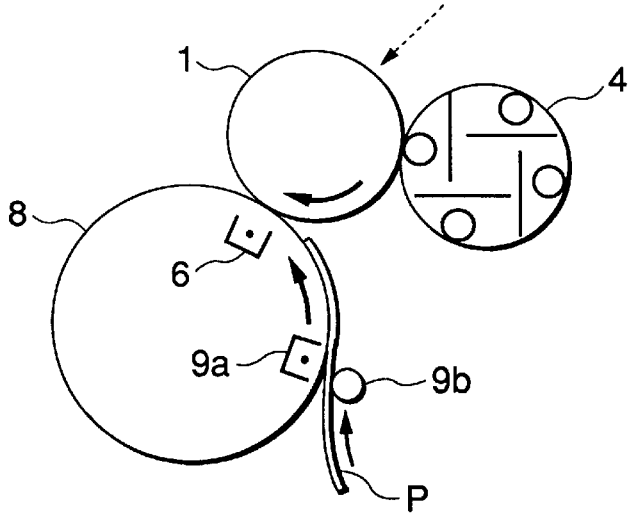
FIGS. 7A to 7C show configuration examples of image formation apparatuses to which the invention can be applied.
Figure 7B:
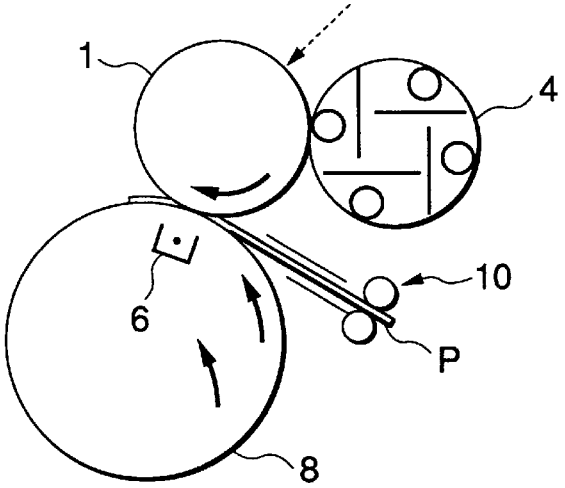
Figure 7C:
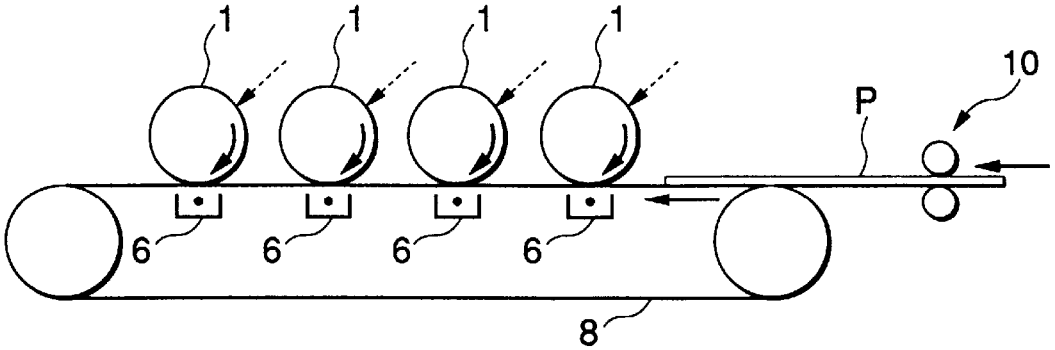
Figure 8A:
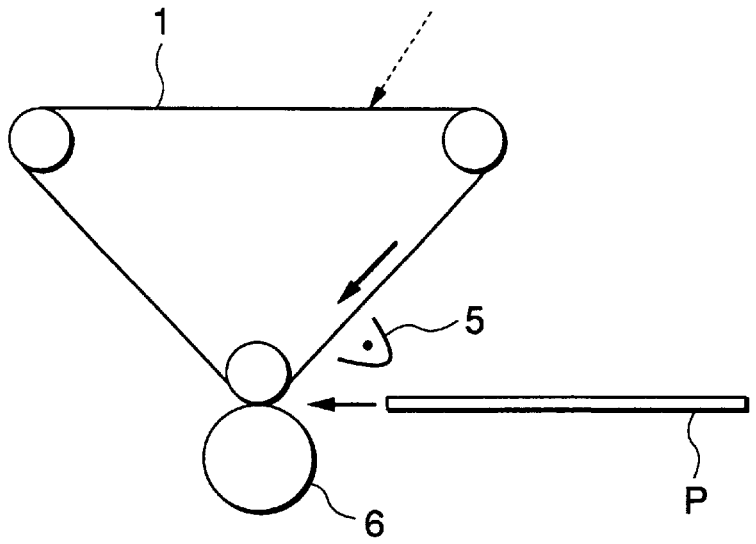
FIGS. 8A and 8B show configuration examples of image formation apparatuses to which the invention can be applied.
Figure 8B:
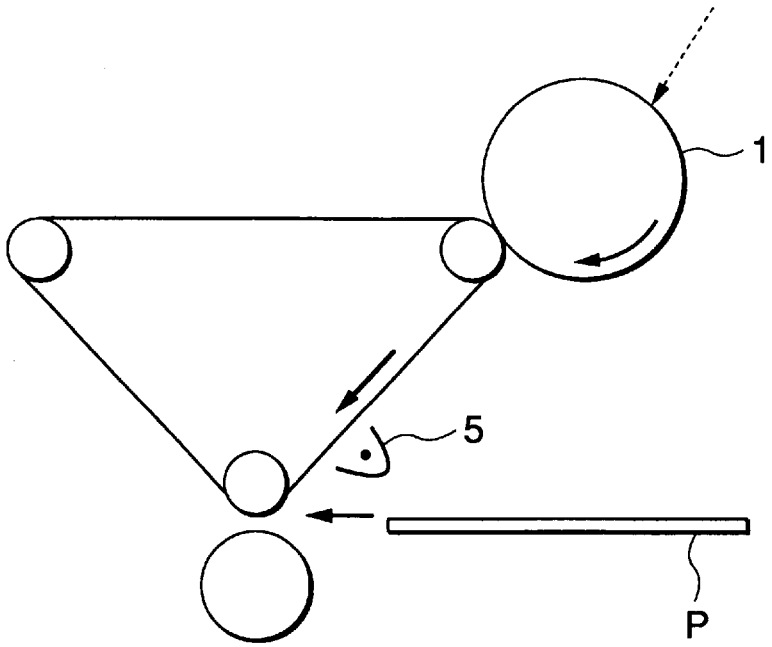

In the configuration, the control means 23 selects appropriate operation conditions out of a setup table shown in FIG. 4 in response to the mode selection signal, corrects the operation conditions in response to temperature information and humidity information from a temperature sensor 27 and a humidity sensor 28 disposed above the transfer material tray 7, and controls the operation of the members under the corrected operation conditions. The surface resistance values, volume resistance values, heat capacities, firmness, and the like of tack film, cloth paper, and transfer material formed with thermally melted bonding layer are measured under standard temperature and humidity conditions and the setup table contents are determined accordingly. The values are multiplied by a predetermined temperature coefficient and a predetermined humidity coefficient, thereby executing the above-described temperature and humidity corrections. FIG. 5 shows the temperature correction results of the transfer voltage value and the before-transfer charge voltage value on the tack film. For example, the surface resistance of the transfer material P is a characteristic governing the toner deposition state on the transfer material P and the volume resistance is a characteristic governing the electric field strength (transfer efficiency) at the transfer time.

The image formation apparatus thus configured is used to form full color images on the tack film, cloth paper, and the transfer material formed with a thermally melted bonding layer. As a result, images of predetermined quality can be formed on each transfer material P without causing a paper jam to occur.

Particularly, when an image is formed on a lowly insulated transfer material of a multilayer structures the transfer material P is not attracted on the photosensitive drum 1 and peel discharge does not occur either; when an image is formed on a highly insulated transfer material of a multilayer structure, nonvisual offset does not occur; when an image is formed on a transfer material formed on a surface with a coating under a humid condition, no toner blisters or paper blisters occur; and when an image is formed on a transfer material of a multilayer structure formed with a bonding layer, the bonding layer does not peel.

Second Embodiment

A second embodiment of the invention differs from the first embodiment in that the control means 23 controls the operation of the members based on the transfer material selection information from the user interface unit 24 in the first embodiment; whereas in the second embodiment, when a special paper mode is selected on a user interface unit 24, a characteristic measurement cycle is executed before image formation on the first sheet of transfer material, the electric resistance value of transfer material P at this time is measured with current value measurement means 29, and control means 23 determines setup values of various corotrons, etc., based on the measurement result.

Specifically, the characteristic measurement cycle is a cycle for attracting transfer material P on a transfer drum 8 with a predetermined transfer voltage applied between the transfer corotron 6 and the photosensitive drum. 1 and making one idle revolution of the transfer material P, thereby measuring the volume resistance value of the transfer material P. The setup values of the corotrons are changed in response to the measurement result and image formation on the transfer material P is continued. To measure the volume resistance value, the current values flowing into the photosensitive drum 1 are measured with respect to the full length of the transfer material P in the transport direction thereof and average volume resistance value is found for improving accuracy of the changed setup value. Only the operation to be changed is specified on a display screen, the characteristic values are sensed for the values to be changed as compared with plain paper before image formation, and the setup values of the transfer material to be changed can also be entered automatically for well handling different transfer materials also containing environmental conditions, etc.

When the image formation apparatus thus configured is used to form full color images on tack film, cloth paper, and transfer material formed with thermally melted bonding layer, similar results to those of the first embodiment can be produced.

As we have discussed the image formation apparatus of the invention is provided with the operation mode dedicated to transfer materials of a multilayer structure. In the operation mode, setting of at least one operation condition of the attraction condition of the transfer material P on the transfer material support, the transfer condition of toner image to the transfer material, the peeling condition of the transfer material P from the transfer material support, the fixing condition of toner image onto the transfer material P, and the static electricity elimination condition of the image support or the transfer material support can be changed in response to the characteristics of the transfer material P for forming an image on the transfer material P under proper operation conditions For the transfer material P of a multilayer structure having complicated characteristics, not only the characteristic values, but also the operation conditions are determined in response to the characteristics.

What is claimed is:

1. An image formation apparatus for transporting a transfer material and forming an image on the transfer material, said image formation apparatus comprising:

setup value change means being responsive to characteristics of transfer material of a multilayer structure, the transfer material being a material having a lamination structure of at least two or more different compositions and being formed like a sheet as a whole, the setup value change means for changing setup values of plain paper for at least one operation condition of an attraction condition of the transfer material on a transfer material support, a transfer condition of a toner image to the transfer material, a peeling condition of the transfer material from the transfer material support, a fixing condition of a toner image onto the transfer material, and a static electricity elimination condition of an image support or the transfer material support.

2. The image formation apparatus of claim 1, wherein setting of operation conditions of at least one charge means of before-transfer charge means, transfer charge means, attraction charge means, peel charge means, and static electricity elimination charge means is changed in response to an electric resistance value of the transfer material of a multilayer structure.

3. The image formation apparatus of claim 1, wherein setting of operation conditions of fixing means is changed in response to a heat capacity of the transfer material of a multilayer structure.

4. The image formation apparatus of claim 1, wherein setting of operation conditions of a peeling claw and setting of a move speed of the transfer material support are changed in response to firmness of the transfer material of a multilayer structure.

5. The image formation apparatus of claim 1, wherein when an image is formed on a transfer material of a multilayer structure lower than a predetermined electric resistance threshold value, setting of a transfer condition or an attraction condition is changed so as to delay application timing of a voltage to said transfer charge means for transferring a toner image to the transfer material or said attraction charge means for attracting the transfer material on the transfer material support as compared with the application timing for plain paper and accelerate stop timing of the applied voltage to said transfer charge means or said attraction charge means as compared with the stop timing for plain paper.

6. The image formation apparatus of claim 1, wherein when an image is formed on a transfer material of a multilayer structure higher than a predetermined electric resistance threshold value, setting of a fixing condition is changed so as to accelerate a transfer material transport speed at fixing time as compared with the transport speed of plain paper.

7. The image formation apparatus of claim 1, wherein when an image is formed on a transfer material of a multilayer structure including a surface with a coating a transfer material transport speed when a toner image is fixed to the transfer material is slowed down as compared with the transport speed of plain paper and a fixing temperature is raised as compared with the fixing temperature of plain paper.

8. The image formation apparatus of claim 1, wherein when an image is formed on a transfer material of a multilayer structure formed with a bonding layer, a transfer material transport speed when a toner image is fixed to the transfer material is accelerated as compared with the transport speed of plain paper and a fixing temperature is lowered as compared with the fixing temperature of plain paper.

9. The image formation apparatus of claim 1, further comprising storage means for storing a series of operation conditions to form a plurality of images, and means for selecting one operation condition out of said storage means in response to characteristics of the transfer material of a multilayer structure.

10. The image formation apparatus of claim 9, further comprising:

input means for changing setup values of the operation conditions in said storage means.

11. The image formation apparatus of claim 1, wherein before an image is formed on the transfer material of a multilayer structure, characteristics of the transfer material are measured and setting of operation conditions of said apparatus is changed based on the measurement result.

12. A display unit comprising:

a first display screen for selecting one from among a plurality of types of transfer materials containing transfer materials of a multilayer structure;

a first key for selecting transfer materials of a multilayer structure out of said first display screen; and a second display screen displayed in exchange for a part or all of said first display screen when said first key is pressed, said second display screen having one or more second keys to enable one to be selected from among transfer materials of a multilayer structure.

13. The display unit of claim 12, wherein said second display screen comprises characteristic value input means to use any transfer material of a multilayer structure other than the transfer materials of a multilayer structure.

14. An image formation apparatus comprising:

means for specifying operation conditions to be changed from plain paper predetermined in response to characteristics of transfer materials of a multilayer structure;

means for measuring characteristics of a transfer material of a multilayer structure before image formation; and means for determining setup values of operation conditions to be changed from plain paper from the result of said measurement means.

* * * * *